US005692452A

United States Patent [19]

Nepovim

[11] Patent Number: 5,692,452

[45] Date of Patent: Dec. 2, 1997

[54] DIAL

[75] Inventor: Zdenek Nepovim, Lindsay, Canada

[73] Assignee: J.E. Thomas Specialties Limited, Lindsay, Canada

[21] Appl. No.: 418,281

[22] Filed: Apr. 7, 1995

[51] Int. Cl.[6] ..... G09F 11/04

[52] U.S. Cl. ..... 116/315; 116/307

[58] Field of Search ..... 116/264, 265, 116/277, 309, 311, 312, 313, 314, 315, 316, 317, 318, 319, 320, 307; 455/6.1, 6.2

[56] References Cited

U.S. PATENT DOCUMENTS

| | | | |
|---|---|---|---|
| 1,644,471 | 10/1927 | Hagerman | 116/315 X |
| 3,610,810 | 10/1971 | Fribley | 174/59 |
| 3,617,811 | 11/1971 | McVoy | 174/59 X |
| 3,641,464 | 2/1972 | Crowhurst et al. | 333/10 |
| 4,373,466 | 2/1983 | MacPhee | 116/315 |
| 4,419,636 | 12/1983 | Yu | 333/131 |
| 4,963,966 | 10/1990 | Harney et al. | 358/349 |
| 5,194,947 | 3/1993 | Lowcock et al. | 455/6.2 X |

*Primary Examiner*—William A. Cuchlinski, Jr.
*Assistant Examiner*—Willie Morris Worth
*Attorney, Agent, or Firm*—Robert L. Westell

[57] ABSTRACT

A plate forming the lid of a housing for use in coaxial cable distribution systems has a first distribution port on one side and a second distribution port. A dial is mounted on the exterior of the plate which will indicate RF current flow and tap values.

17 Claims, 3 Drawing Sheets

DIAL

BACKGROUND OF THE INVENTION

This invention relates to an indicator for a housing for coaxial cable distribution networks. By the term 'coaxial cable distribution networks', I include Community Antenna Television (CATV) networks, Local Area (LAN) Networks, and other coaxial applications, particularly those which require broad-band transmission. The indicator is used with a multitap housing indicative of the tap port values (or 'tap values') and of the signal distribution direction into and out of the housing.

The multitap housings to which the invention relates: have covers which are known as 'plates', are generally rectangular and usually designed to have their long axis horizontal for aerial mounting and their long axis vertical for pedestal mounting. However, within the scope of the invention the long axis may be vertical and horizontal for aerial and pedestal mounting respectively, or the housing may be square. Although the plate is not perfectly planar it may be thought of as defining a median plane being the plane which most closely approximates the plate shape. It will have a number (frequently 2,4 or 8) tap ports.

This invention is concerned with housings where all tap ports have equal value. Thus, the housing commonly has in one end two ports : commonly called a 'common' and a 'pedestal' distribution port and at the other end which is often called an 'aerial' port. The housing connection will involve the use of the common port and one of the other ports. This much will be obvious to any observer of the connected housing in situ. The housing will normally contain a directional coupler and a splitter as is well known to those skilled in the art.

The direction of the distribution signal (which may be referred to as the signal direction through the common port) is not obvious nor is the tap value (measured in dB at the tap port).

This invention provides for the outer surface of the plate, a convenient indicator of the tap values and of the signal direction through the common port.

The invention may also be used with two port housings. That is it may be used with (a) a housing which has two ports in one end and is therefore dedicated to pedestal mounting or a housing which has two ports which are in opposed ends, and is therefore dedicated to aerial mounting.

The practice, prior to this invention, is to place a label on the plate. This is sufficient for multitaps where, to change the tap value, the whole plate is replaced by another one and where, to change the distribution direction the plate or the whole tap is rotated 180°.

The plate in accord with this invention is for use with a multitap where the directional coupler may be replaced to alter the tap value or turned around to reverse the intended signal direction. In either case, the plate remains the same.

To indicate distribution direction and tap value it is not practical for the linemen to label the plate since the lineman is frequently out of proper labels and such labels may become detached or illegible because of weathering or for a variety of reasons. Handwriting over the existing label may not be possible in some weather conditions and may not be legible.

SUMMARY OF THE INVENTION

This invention provides a rotatable dial on which are inscribed at selected positions the possible tap values. The rotary disk is pivotally mounted on the outside of the plate to rotate about a pivotal axis perpendicular to the median plane of the plate. The dial has a scale inscribed with indicia indicative of the set of possible tap values.

In a preferred embodiment first and second datum points are provided on the plate each for selective association with a selected tap value on the scale. The first and second datum points correspond to alternative distribution signal directions through the common tap. The datum points and scale are arranged so that there is no setting at which a scale value is opposite both datum points.

Thus the fact that one datum has a scale value associated with it indicates the direction of the signal through the common port. The scale value indicates the tap value.

The dial and plate are provided with means mechanically providing that the index may be releasably fixed at positions associating individual ones of the available tap values with the selected one of the datum points. Means for adjusting the dial over the mechanical inhibition of the releasable restraint may be manual or mechanical.

The lineman installing or modifying the contents of the housing, whether on a pedestal or a aerial mount will, before applying the plate, be aware (or will be made aware) of the tap value and signal direction. He will thus be in a position to adjust the scale to indicate the installed tap value against the datum whose selection indicates the installed signal direction through the common terminal. Anyone later inspecting the plate of the closed box will already know whether it is on a pedestal or aerial mount, may read the tap value from the scale and from the datum used, the signal direction through the common port.

Preferably the scale marked in possible tap values is pivotally mounted on a shaft or pin transverse to the median plane and encompasses less than 180°. First and second datum points are approximately 180° apart, each located for selective association with selected values on the scale. The limit to the angular arc of the scale and the relative location of the datum points ensures that there cannot be scale values opposite both datums simultaneously hence there can be no ambiguity about the distribution signal direction.

In an alternative but less preferred form a pivotally mounted dial encompasses a pair of scales each encompassing less than 180° in azimuth about the pivot axis. Marks corresponding to each of the tap values appears on each scale. The marks on one scale correspond to a radially inward directional indication on the dial while the marks on the other scale correspond to a radially outward directional indication on the dial. Thus the choice of scale placed opposite the single datum indicates on the housing plate the signal direction through the housing while the scale value opposite the datum indicates the tap value.

As with the previous embodiment, the dial and plate are provided with means mechanically providing that the index may be releasably fixed at positions associating individual ones of the tap values on either scale with the datum. The lineman may set the scale to indicate the tap value and RF signal direction as with the other embodiment.

BRIEF DESCRIPTION OF THE DRAWINGS

In drawings which illustrate a preferred embodiment of the invention.

DESCRIPTION OF PREFERRED EMBODIMENTS

Figure 3:
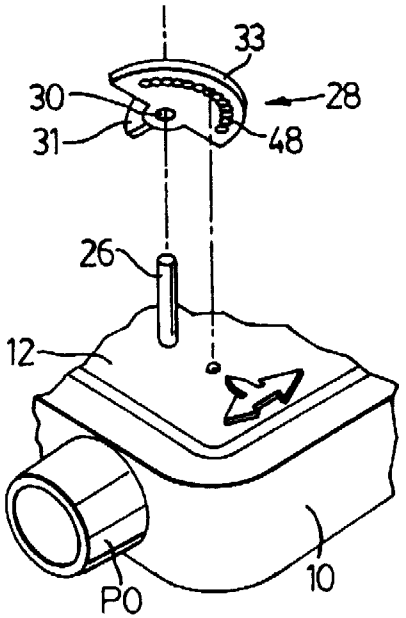
FIG. 3 is a partial perspective of the housing, plate and dial showing the cooperating means on the plate and dial.
Figure 4:
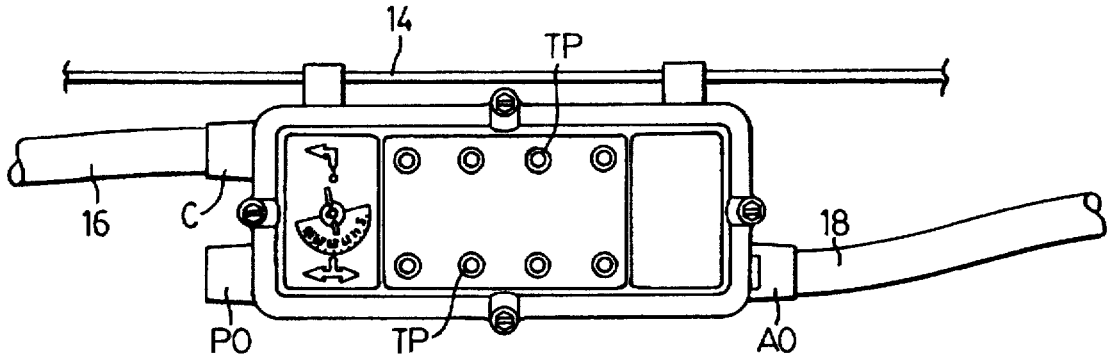
FIG. 4 shows a plate in accord with the invention, mounted on a housing, which housing is aerial mounted.

In the drawings a housing 10 (FIG. 3) and cover plate 12 are shown. The housing has ports: C—common, PO—pedestal and AO aerial. In FIG. 4 the housing is shown installed on an aerial mount on a cable 14 with ports C and AO connected to distribution cables 16 and 18.

Figure 5:
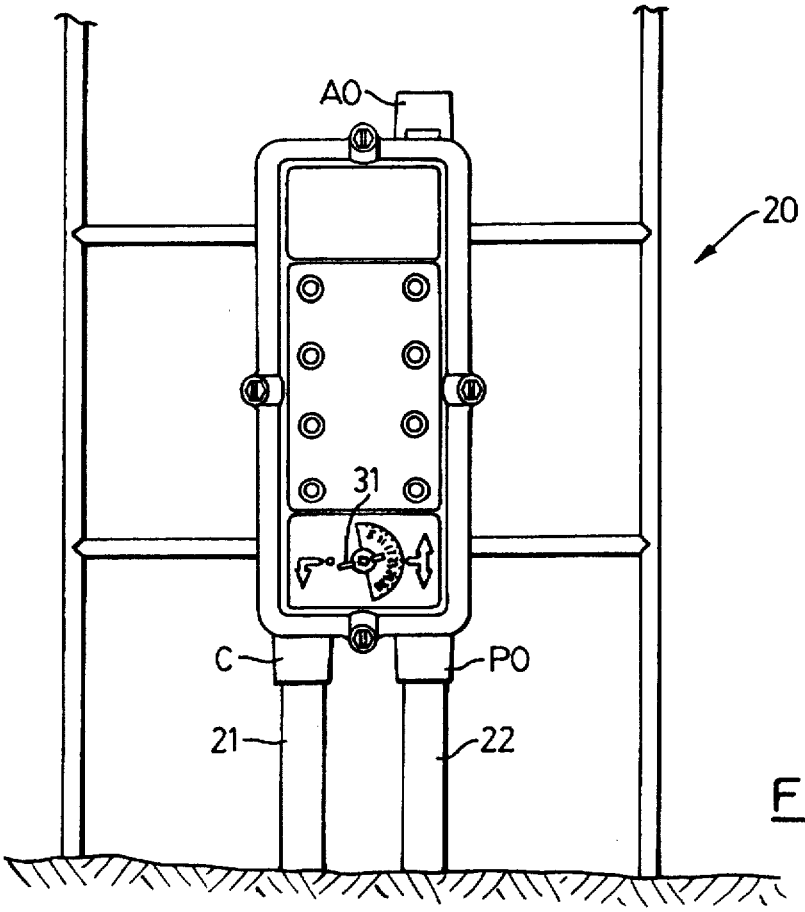
FIG. 5 shows a plate in accord with the invention, mounted on a housing, which housing is pedestal mounted.

In FIG. 5 the housing is shown installed on a pedestal mount, on a frame 20 and the distribution cables 21 and 22 are connected to terminals C and PO.

The electronic and electric circuitry of the housing and the various techniques for handling the radio frequency ('RF') signal and alternating current ('AC') are conventional and well known to those skilled in the art. However, it should be noted that the proper operation of such circuitry depends upon the direction of RF signal flow through the distribution cables. For example, contents of the housing will frequently contain a directional coupler and a splitter. The directional coupler must be correctly connected having regard to the distribution signal direction and the splitter will determine the port tap values appearing at tap ports or 'F ports' 24. Although it is possible that tap ports could, in some applications have different tap values this invention deals with designs where all tap values are the same.

The housing and plate are customarily cast out of zinc alloy or aluminum or its alloys.

The housing 10 and plate 12 are generally rectangular in plan.

Details of the ports C, AO and PO and the various techniques of connecting them to the distribution cables, and details of the connection of lines to the tap or F ports are omitted as well known to those skilled in the art.

The housing and plate are generally rectangular in plan. The plate approximates a flat shape parallel to the plane of the paper in FIGS. 1,2,4 and 5. Thus the plane of the paper in these figures may be considered as the 'median plane' of the plate for the purposes of the specification and claims herein.

The plate is customarily attached to the housing by bolts 22. An array of tap or F ports 24 are customarily located on the plate. The tap ports 24 allow for transmission by drop cables (not shown) to the CATV subscribers'premises. Eight ports 24 are shown. However two and four ports are also typical and more than eight is possible. The invention contemplates that all tap values (measured in decibels 'dB' relative to the incoming signal) are the same. The array of ports 24 can be located other than as shown, and as desired.

Toward the end of the panel preferably nearer the common and pedestal ports, a post 26 is formed, preferably, as part of the cast plate 12. A dial 28 is customarily molded out of one-piece plastic and includes a bore 30 dimensioned to slidably receive post 26 and allow rotation of the dial thereon. After the installation of the dial 28 on the post 26 the outer end of the post 26 is flaired out as indicated at 32 to maintain the dial (rotatably) in place. The one-piece dial 28 includes an arcuate outwardly facing edge 33 with scale 34 concentric with the pin and encompassing not more than 180°. The edge 33 defines a circular locus on rotation of the dial. Finger tabs 31 perpendicular to the median plane extend radially on opposite sides of the bore to allow manual manipulation of the dial. The finger tabs are preferably molded integrally with the dial. The scale will display customarily possible tap values. Here the scale shows tap values 5,11, . . . 35 in 6 dB intervals. Usually such tap values are at 3 dB intervals but the size of the scale renders it better to numerically indicate only alternate values.

Thus it is contemplated that the scale shown will stop not only at mark 37 opposite the values indicated but half way between at one of non-numbered marks 36 in between or there-adjacent to indicate a range of values separated at 3 dB intervals i.e. 2,5,8,11,14 . . . 32,35,38.

The arcuate dial edge defines a circular locus 34. Just outside of this locus on the entrance end of an arrow 40 the plate defines a datum for registration the marks 36,37 of the scale (see FIG. 2). The entrance end of arrow 40 is located transversely relative to the housing's longitudinal axis from the post 26 and extends to an exit end pointed toward and adjacent port C. An arrow 42 has its entrance end diametrically opposed to that of arrow 36 and forms a datum for the scale (see FIG. 1). From the entrance end the arrow 42 extends toward the plate edge and then splits into two outwardly directed exit ends parallel to the longitudinal axis of the plate. One of the ends is directed to and adjacent to port PO and the other exit end is directed toward port AO.

There is provided a bump or raised portion 44 on plate 12 just inside the locus of edge 33 and adjacent the entrance end of arrow 40. A second bump or raised portion 46 is located just inside the locus and adjacent the entrance end of arrow 42 (that is diametrically opposed to raised portion 44). The raised portions 44 and 46 are typically rounded bumps which cooperate with generally complementary dimples 48 on the lower side of dial.

Preferably post 26, arrows 40 and 42 and raised portions 44 stand out from the plate and are formed during its casting.

The dimples 48 are arcuately arrayed on a path intersecting the position of the raised portions. The dimples are arranged to releasably position the dial at 3 dB intervals between 2 dB and 38 dB on the scale. Thus there are 13 dimples and each corresponds to a pair of desired indexing positions for the scale. Thus the left hand in FIG. 3 in cooperation with raised portion 44 will position the mark for 38 dB opposite the entrance end of arrow 40 while the adjacent dimple will place the scale marking for 35 dB opposite the entrance end of arrow 40. Similarily the dial dimples will cooperate with raised portion 46 to indicate tap values at the entrance end of arrow 42 such values ranging from 2–38 in 3 dB steps.

Figure 1:
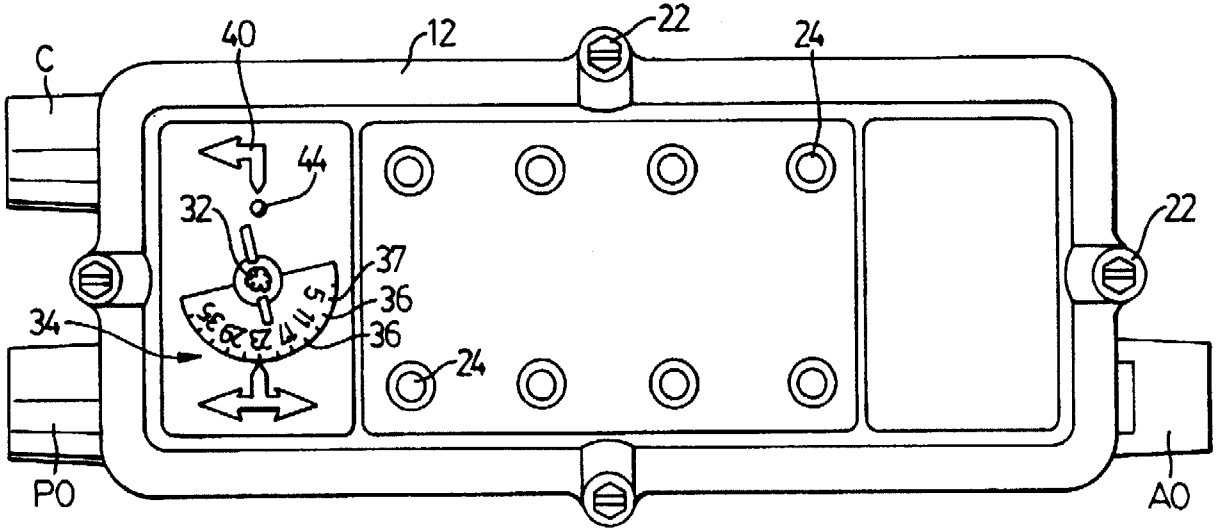
FIG. 1 is a plan view of a plate installed on a housing, with a scale setting indicating, inward signal flow through the common port.
Figure 2:
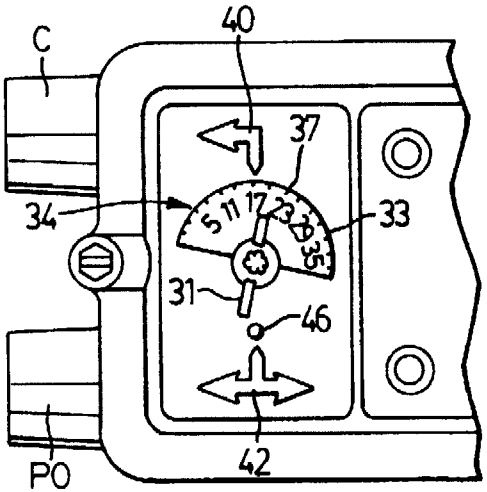
FIG. 2 is a partial plan view of the plate of FIG. 1 with a scale indicating outward signal flow through the common port.

Thus the dial with the scale set as in FIG. 1, indicates that the distribution signal direction is from the port C to the port PO or PA and the tap values are 23 dB while the scale setting of the dial in FIG. 2 indicates that the distribution signal direction is from port PO or AO to port C and that the tap value is 17 dB.

It will be noted that no ambiguity can occur because the scale of not more than 180° of arc cannot be opposite both arrow ends at once.

The dial, preferably of plastic, is made sufficiently flexible that the dial will flex, under rotational digital pressure on finger vanes 31 to allow the dial to release from a dimple and the raised portion contact and move to another dimple and raised finger contact.

In operation then, the lineman, aware of the distribution direction and of the tap values of the tap ports 24 will set the tap value against the arrow indicating the distribution direction.

Figure 7:
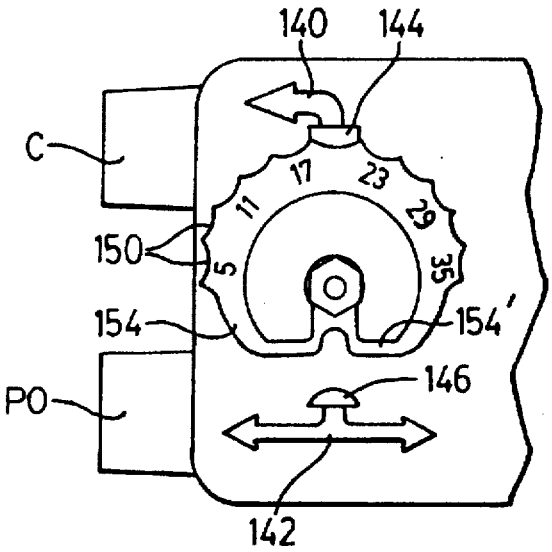
FIG. 7 shows schematically a preferred version of the embodiment of FIG. 1.

FIG. 7 shows, schematically, a preferred embodiment of the dial shown in FIGS. 1–5. FIG. 7 is drawn to give a representation analogous to FIG. 2.

In FIG. 7 the housing, plate attaching means and ports are as shown in FIGS. 1–5. FIG. 7 shows the C and PO ports. The arrows 140 and 142 have the same purpose and indications as the arrows 40 and 42, respectively, in FIG. 2.

Arrows 140 and 142 terminate adjacent the dial in raised ends 144 and 146 which form convexities facing the dial. Members 140, 142, 144 and 146. The dial 134 is cast of resilient plastic and comprises a scale ring generally concentric with the dial pivot axis marking possible tap values (here 5–35 dB at 6 dB intervals) having concavities 150 complementary with ends 144 and 146 at positions at 3 dB intervals (as with the dial in FIGS. 1–5). The scale ends contiguously extend into thin strips 154 and 154 which extend away from the center of the scale beyond the dial pivot pin 132, then extend toward each other to join and extend to define the hub with pivot aperture. The hub is preferably cast to define a raised hexagonal portion as shown which allows the use of a wrench to rotate the dial. Any conventional means, not shown, may be employed to pivotally mount the dial on shaft 132.

The complementary concavities 150 and convex raised ends 144 and 146 allow the setting of the dial at a selected value in cooperation with either raised end 144 or 146. The dimples 48 and bumps 44 and 46 are not required. As with the dial of FIGS. 1–5 the scale encompasses less than 180° of arc so that settings may not be indicated simultaneously at ends 144 and 146. The thin strips, 154 and 154' contribute enough resilient flexibility to the dial to tolerate the radial movement of the dial in moving from one setting to another.

In other respects the dial of FIG. 7 operates as does the dial of FIGS. 1–5.

Figure 6:
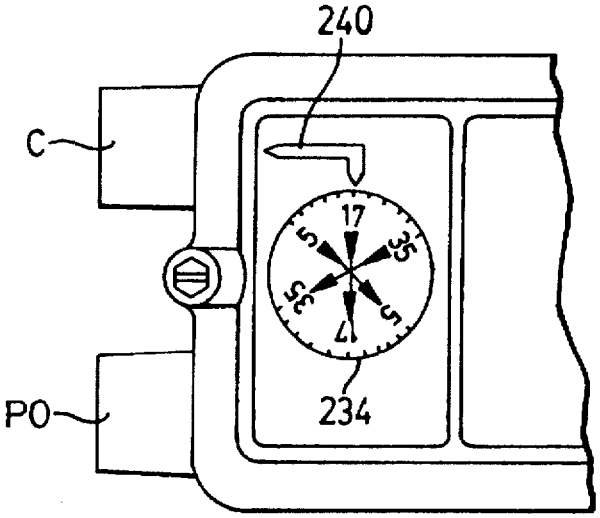
FIGS. 6 and 6A show schematically an alternate form of the invention to that shown in FIGS. 1–5.

In FIG. 6 an alternate dial (although not preferred is shown). In FIG. 7 the dial 234 encompasses 360°. The dial carries two scales of tap values over the range available. Each scale encompasses less than 180° of azimuth about the central pivot point. Some tap values and arrows are omitted in FIG. 5 for clarity. Dial arrows extend diametrically across the dial from equivalent tap values on the two scales. The plate has a single linear indicator 240 extending from a point adjacent the dial periphery to a point adjacent the common terminal C. The linear indicator does not indicate the sense of the direction. The plate is provided with a single raised portion (not shown), corresponding to 44 (or 46) of FIG. 1 and the dial has 22 dimples (not shown) corresponding to dimples 48 in FIG. 3 and arranged to provide 11 tap value registrations with the adjacent end of the linear indicator 240.

In operation a lineman wishing to indicate 17 dB tap setting and a RF signal from common terminal C would set away from the dial as shown in FIG. 6, the RF signal direction being indicated by a dial arrow near the rear end of 240. If the RF signal direction is toward the common terminal C then the other scale is used so that the scale value opposite the adjacent end of the linear indicator 240 is accompanied by the arrow indicating the RF signal flow toward the common terminal.

The preceding description has dealt with housings having three ports here called C, P, and O. The invention, including dials is equally applicable to housings having only two ports, that is housings dedicated to either pedestal or aerial mount.

With reference first to FIGS. 1–5, a housing for use only with a pedestal mount would have only the ports at one end of the housing called C and PO. Port AO would be omitted. Thus arrow 42 would be revised so that, it had only the left hand limb—pointing toward port PO, but the design would otherwise be the same. Similar comments apply to the embodiment of FIG. 7 where the right hand limb of arrow 142 would be removed. The embodiment of FIG. 6 would be unchanged.

With a housing for use only with an aerial mount, ports at opposite ends of the housing but the third port at one end (here called PO) would be omitted. Accordingly, in the embodiment of FIG. 1 the left hand limb of arrow 42 would be omitted and the right hand retained. No other change would be required. Similarily in the embodiment of FIG. 7 the left hand limb of arrow 142 would be omitted and the right hand retained, and no other changes would be required. No changes would be required in the embodiment of FIG. 6.

Without, in any way, circumscribing the range of equivalents legally available to applicant of the components or combinations disclosed or claimed herein, it is desired to discuss briefly some equivalents which are considered by applicant to be within the scope of the invention.

Dial—the dial may be made of other materials than plastic.

Flexibility—the flexibility allowing release of the dial from set positions may be achieved by other means than a flexible dial or by other dial materials.

Releasable stop—the dimples on the dial and raised portions on the plate may obviously be reversed. Other releasable means of indexing the dial at the desired indexing position may be used, including the use of radial releasable interfering means on the dial end plate.

Centre post—the cast centre post may be replaced with a bolt, screw or equivalent.

The arrows cast into the plate may be replaced with labels or equivalent, although the permanence of the cast arrows is preferred.

The dial may be shaped for rotation by a tool, in addition or alternatively to manually.

Although the ports are spoken of as being in the 'ends' of the housing, the ports may be located in the longer opposed sides of the housing or on opposed sides of the housing were square.

Figure 6A:
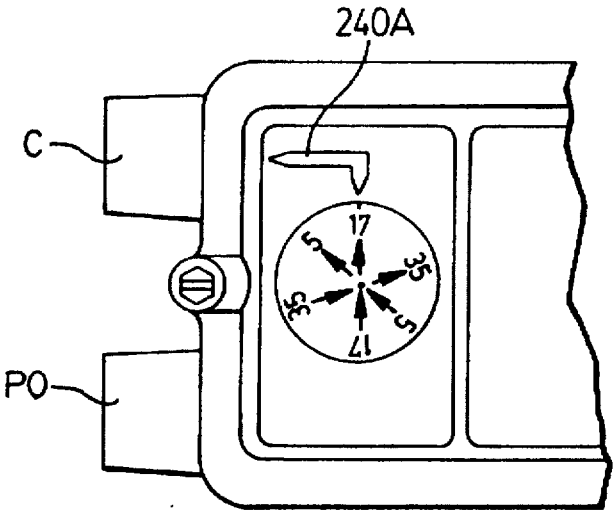

FIG. 6A shows dial 240A the dial of FIG. 6 changed only to replace each diametrical arrow of dial 240A with a pair of in-line arrows on opposite sides of the pivot axis. The indication is the opposite as with FIG. 6, that is the dial arrow indicates flow toward the common terminal and tap value 17 dB, but in FIG. 6A the two scales do not have to have identical tap values diametrically opposed.

I claim:

1. A plate defining a median plane for a generally rectangular housing which housing has: a first distribution port and at least one second distribution port, a dial mounted on an exterior surface of said plate to pivot at a pivot point about an axis transverse to the median plane, said dial having a scale with indications of a plurality of tap values accurately distributed thereabout, a first datum point on said plate for association with one of said indications, and selected by rotation of said dial for indicating one distribution direction through said first distribution port, a second datum point on said plate for association with one of said indications selected by, rotation of said dial for indicating a second distribution direction through said first distribution port, said indications of tap values being arranged in cooperation with said datum points so that only one datum point may be associated with any one of said indications of tap values in any pivotal position of said dial, means for releasably fixing said dial in positions where a selected one of said indications is associated with a selected one of said datum points.

2. A plate as claimed in claim 1 wherein there are two second distribution ports located on opposed sides of said housing and said first distribution port is located on one of said sides.

3. A plate as claimed in claim 1 wherein said dial provided with an edge defining an are concentric with said pivot point, and said means for releasably fixing the orientation of said dial includes frictionally interfering locations between said dial and raised portions on said plate to define said positions, and said dial is made to be sufficiently flexible to allow limited radial movement of said edge, to allow movement of said dial between said positions.

4. A plate as claimed in claim 1 wherein said means for releasably fixing said dial comprises one of a raised point and a dimple on said plate corresponding to each said datum point and facing said dial and wherein said dial has the other of said raised point and dimple corresponding to each tap value, each said dimple being adapted to releasably receive each raised point to releasably fix said dial in position, said dial being sufficiently flexible to allow the raised point to move out of said dimple on rotation of said dial.

5. A plate as claimed in claim 1 wherein said plate is cast and said first and second datum points are cast with the plate.

6. A plate defining a median plane for a generally rectangular housing which housing has: a first distribution port and at least one second distribution port, a dial mounted on an exterior surface of said plate to pivot at a pivot point about an axis transverse to the median plane, said dial having a substantially arcuate edge substantially concentric about said axis, said arcuate edge extending for not more than 180° about said axis, first and second diametrically opposed datum points indicated on said plate adjacent the locus of said arcuate edge, indications of tap values forming a scale on said dial near said edge and located for selective association with either one of said datum points, means for releasably fixing said dial in selected positions corresponding to the selective association of one of said indications of tap values with either one of said datum points, said datum points respectively being associated with an indication of the direction of distribution through said first distribution port.

7. A plate as claimed in claim 6 wherein there are two second distribution ports located on opposed sides of said housing and said first distribution port is located on one of said sides.

8. A plate as claimed in claim 6 wherein said means for releasably fixing the selected position of said dial includes frictionally interfering locations between said dial and raised portions on said plate to define said selected positions, and said dial is made to be sufficiently flexible to allow limited radial movement of said edge, to allow movement of said dial between said selected positions.

9. A plate as claimed in claim 6 wherein said means for releasably fixing said dial comprises one of a raised point and a dimple on said plate corresponding to each said datum point and facing said dial and wherein said dial has the other of said raised point and dimple corresponding to each tap value, each said dimple being adapted to releasably receive each raised point to releasably fix said dial in position, said dial being sufficiently flexible to allow the raised point to move out of said dimple on rotation of said dial.

10. A plate as claimed in claim 6 wherein said plate is cast and said first and second datum points are cast with the plate.

11. A plate defining a median plane for a generally rectangular housing which housing has a first distribution port and at least a second distribution port, a dial pivotally mounted at a pivot point on an exterior surface of said plate, said dial having a scale of indications of possible tap values, datum means on said plate for cooperation with said scale to indicate the direction of signal through said first port and to indicate a selected one of said tap values.

12. A plate as claimed in claim 1 wherein there are two second distribution ports located on opposed sides of said housing and said first distribution port is located on one of said sides.

13. A plate as claimed in claim 11 wherein said dial provided with an edge defining an arc concentric with said pivot point, and means for releasably fixing the orientation of said dial including frictionally interfering locations between said dial and raised portions on said plate to define a plurality of positions associated with said tap values, and said dial is made to be sufficiently flexible to allow limited radial movement of said edge, to allow movement of said dial between said positions.

14. A plate as claimed in claim 11 including means for releasably fixing said dial comprising one of a raised point and a dimple on said plate corresponding to said datum means and facing said dial and wherein said dial has the other of said raised point and dimple corresponding to each tap value, each said dimple being adapted to releasably receive each raised point to releasably fix said dial in position, said dial being sufficiently flexible to allow the raised point to move out of said dimple on rotation of said dial.

15. A plate defining a median plane for a generally rectangular housing which housing has a first distribution port and at least a second distribution port, a dial mounted on an exterior surface of said plate to pivot, at a pivot point about an axis transverse to the median plane, said dial having in 180° of azimuth about said pivot point a scale of tap value indications associated with radially inward arrows for indicating a distribution direction associated with said tap value indications, and in the other 180° of azimuth about said pivot point said dial having a scale of the same tap value indications associated with at least one arrow indicating the opposite distribution direction associated with said tap value indications.

a datum point on said plate for association with a selected one of said tap value indications on an associated one of said scales, means for releasably fixing said dial in positions where a selected one of said value indications is associated with said datum point.

16. A plate as claimed in claim 15 wherein said datum point is cast on said plate.

17. A plate as claimed in claim 16 wherein said means for releasably fixing said dial comprises one of a raised point and a dimple on said plate corresponding to each said datum point and facing said dial and wherein said dial has the other of said raised point and dimple corresponding to each tap value, each said dimple being adapted to releasably receive each raised point to releasably fix said dial in position, said dial being sufficiently flexible to allow the raised point to move out of said dimple on rotation of said dial.

* * * * *